US008727233B2

(12) United States Patent
Karp

(10) Patent No.: US 8,727,233 B2
(45) Date of Patent: May 20, 2014

(54) PRESSURE SPRAY WASHER AND CONTROL

(75) Inventor: Brian G. Karp, Siloam Springs, AR (US)

(73) Assignee: Champion Power Equipment, Inc., Santa Fe Springs, CA (US)

( * ) Notice: Subject to any disclaimer, the term of this patent is extended or adjusted under 35 U.S.C. 154(b) by 117 days.

(21) Appl. No.: 13/275,119

(22) Filed: Oct. 17, 2011

(65) Prior Publication Data

US 2013/0092745 A1 Apr. 18, 2013

(51) Int. Cl.
*B05B 17/04* (2006.01)

(52) U.S. Cl.
USPC ..... 239/11; 239/1; 239/69; 239/124; 239/146; 239/526; 239/70; 239/74; 239/722; 417/34; 417/234

(58) Field of Classification Search
USPC ..... 239/1, 11, 67, 69, 124, 127, 146, 289, 239/525, 526, 722, 754, 70, 74; 417/34, 43, 417/234, 364
See application file for complete search history.

(56) References Cited

U.S. PATENT DOCUMENTS

| | | | | |
|---|---|---|---|---|
| 3,888,325 | A | 6/1975 | Reinbeck et al. | |
| 4,124,332 | A | 11/1978 | Nishijyo | |
| 4,387,850 | A * | 6/1983 | Gerber | 239/124 |
| 4,551,037 | A | 11/1985 | Kille et al. | |
| 4,870,811 | A | 10/1989 | Steele | |
| 4,882,896 | A | 11/1989 | Wilcox | |
| 5,085,043 | A | 2/1992 | Hess et al. | |
| 5,208,525 | A | 5/1993 | Lopic et al. | |
| 5,259,556 | A * | 11/1993 | Paige et al. | 239/124 |
| 5,406,778 | A | 4/1995 | Lamb et al. | |
| 5,421,520 | A | 6/1995 | Simonette et al. | |
| 5,442,901 | A | 8/1995 | Niemela et al. | |
| 5,529,460 | A * | 6/1996 | Eihusen et al. | 239/124 |
| 5,606,851 | A | 3/1997 | Bruener et al. | |
| 5,784,868 | A | 7/1998 | Wadzinski et al. | |
| 5,794,580 | A | 8/1998 | Galletti | |

(Continued)

FOREIGN PATENT DOCUMENTS

| | | |
|---|---|---|
| EP | 2332768 | 6/2011 |
| JP | 2006263628 | 10/2006 |
| WO | WO2007027149 A1 | 3/2007 |

OTHER PUBLICATIONS

International Search Report for PCT/US2013/059375 Filed Oct. 9, 2012 for Pressure Spray Washer and Control in the name of Champion Power Equipment.

*Primary Examiner* — Steven J Ganey
(74) *Attorney, Agent, or Firm* — Stetina Brunda Garred & Brucker; Lowell Anderson

(57) ABSTRACT

A method and apparatus is provided for starting and stopping a high pressure spray washer having a combustion engine driving a pump to provide high pressure fluid to a spray gun activated by a trigger. Pulling the trigger causes water to flow through the nozzle and pump and a sensor by the pump sends a flow start signal to a control module that activates an electric starter when an engine switch is turned on, thus starting the engine when it wasn't running. When the trigger is released flow to the pump stops and the sensor sends a flow stop signal to the control module. If a predetermined time passes before the sensor detects fluid flow to the pump as occurs when the trigger is pulled, then the engine is shut off. The time can be varied to adjust the time between releasing the trigger and shutting off the engine.

21 Claims, 5 Drawing Sheets

(56) References Cited

U.S. PATENT DOCUMENTS

| | | | |
|---|---|---|---|
| 5,906,088 | A | 5/1999 | Inui et al. |
| 5,910,091 | A | 6/1999 | Iida et al. |
| RE36,250 | E | 7/1999 | Hess et al. |
| 5,934,053 | A | 8/1999 | Fillman et al. |
| 5,937,623 | A | 8/1999 | Wolf |
| 6,077,186 | A | 6/2000 | Kojima et al. |
| 6,078,015 | A | 6/2000 | Martinez |
| 6,160,373 | A | 12/2000 | Dunn et al. |
| 6,220,005 | B1 | 4/2001 | Plamper et al. |
| 6,230,678 | B1 | 5/2001 | Gracyalny et al. |
| 6,260,529 | B1 | 7/2001 | Gracyalny et al. |
| 6,263,852 | B1 | 7/2001 | Gracyalny et al. |
| 6,311,663 | B2 | 11/2001 | Gracyalny et al. |
| 6,325,036 | B1 | 12/2001 | Gracyalny et al. |
| 6,386,169 | B1 | 5/2002 | Gracyalny et al. |
| 6,404,078 | B1 | 6/2002 | Thomas et al. |
| 6,523,334 | B1 | 2/2003 | Dettmann |
| 6,571,542 | B1 | 6/2003 | Fillman et al. |
| 6,595,176 | B2 | 7/2003 | Poehlman et al. |
| 6,615,787 | B2 | 9/2003 | Gracyalny |
| 6,622,683 | B2 | 9/2003 | Gracyalny et al. |
| 6,647,942 | B2 | 11/2003 | Poehlman et al. |
| 6,666,008 | B2 | 12/2003 | Iida et al. |
| 6,751,936 | B2 | 6/2004 | Kucera et al. |
| 6,758,030 | B2 | 7/2004 | Dettmann |
| 6,826,895 | B2 | 12/2004 | Iida et al. |
| 6,854,669 | B2 | 2/2005 | Anthony |
| 7,007,446 | B2 | 3/2006 | Dettmann |
| 7,128,037 | B2 | 10/2006 | Tumback et al. |
| 7,180,200 | B2 | 2/2007 | Walter et al. |
| 7,309,928 | B2 | 12/2007 | Grant et al. |
| 7,434,642 | B2 | 10/2008 | Dettmann |
| 7,479,754 | B2 | 1/2009 | Lucas et al. |
| 7,540,132 | B2 | 6/2009 | Shimada et al. |
| 7,677,017 | B2 | 3/2010 | Holby |
| 7,687,926 | B2 | 3/2010 | Grant et al. |
| 7,728,534 | B2 | 6/2010 | Lucas et al. |
| 7,762,787 | B2 | 7/2010 | Kawakami |
| 7,782,626 | B2 | 8/2010 | Buck et al. |
| 7,989,969 | B2 | 8/2011 | Grant et al. |
| 2004/0012204 | A1 | 1/2004 | Walter et al. |
| 2006/0027253 | A1 | 2/2006 | Kaiser |
| 2006/0245941 | A1 | 11/2006 | Sharp |
| 2008/0120955 | A1 | 5/2008 | Lucas et al. |
| 2008/0223012 | A1 | 9/2008 | Rosa et al. |
| 2008/0245899 | A1 | 10/2008 | Parris et al. |
| 2008/0289309 | A1 | 11/2008 | Gust et al. |
| 2009/0064957 | A1 | 3/2009 | Grybush |
| 2009/0223475 | A1 | 9/2009 | Wilson et al. |
| 2009/0255502 | A1 | 10/2009 | Cook |
| 2009/0278509 | A1 | 11/2009 | Boyles et al. |
| 2010/0243086 | A1 | 9/2010 | Gilpatrick |
| 2011/0189032 | A1 | 8/2011 | Hukriede et al. |
| 2013/0111864 | A1 | 5/2013 | Hansen et al. |
| 2013/0343906 | A1 | 12/2013 | Funke et al. |

* cited by examiner

PRESSURE SPRAY WASHER AND CONTROL

BACKGROUND

Gasoline engine powered pressure washers typically run at a fixed throttle position. If the engine is shut off, it has to be manually started which is time consuming as it requires the operator to return to the engine. Thus, the engine produces a continuous, high noise level when the gun trigger is both pulled to release high pressure spray, and when the trigger is released and no spray is being ejected. Further, when the engine runs the pump runs and if the spray gun is not spraying the pump re-circulates the water within the pump, causing the pump and water to heat. After a minute or two of re-circulating water the pump can overheat which may damage seals or bearings.

The Electric pressure-spraying machines produce no noise when the gun trigger is released, but produce noise when the trigger is pulled and the motor compresses fluid for spraying. Unfortunately, the electric powered compressors run off of 120 volt power sources and require an electrical cable that has safety risks around the water used in the spray washers. Further, because they do not require electrical cords, the fuel engine powered water compressors may be used in locations where electrical outlets are not available, and thus provide more versatile use, but the constant noise and exhaust is a disadvantage. There is thus a need for a gasoline pressure washer that reduces noise when the pressure is not being used to spray fluid, and that reduces exhaust. There is a further need for a gasoline pressure washer that automatically starts the engine when high pressure spray is needed and automatically stops the engine when no high pressure spray is needed.

BRIEF SUMMARY

There is provided an engine-powered pressure washer that does not require the user to manually start the engine and that shuts the engine off a predetermined time after spraying stops. The high pressure spray washer has a combustion engine driving a pump to provide high pressure fluid to a spray gun activated by a trigger. Pulling the trigger causes water to flow through the nozzle and pump and a sensor by the pump provides a flow start indicator that is sent to or detected by a control module that activates an electric starter when an engine switch is turned on, thus starting the engine when it wasn't running. When the trigger is released flow to the pump stops and the sensor provides a flow stop indicator that is sent to or detected by the control module. If a predetermined time passes and no flow start indicator has been provided by the sensor indicating that fluid flow to the pump has began (as would occur if the trigger was pulled), then the control module shuts the engine off. The time can be varied to adjust the time between releasing the trigger and shutting off the engine. The sensor may be a flow sensor located on the inlet side of the pump, advantageously located between the inlet coupling and the pump, and preferably located at or near the inlet coupling. The sensor could be a pressure sensor located on the outlet side of the pump, advantageously located between the pump outlet and the outlet coupling on the housing.

There is also provided an apparatus for supplying pressurized fluid to a high pressure washing device for use with a spray gun having a trigger connected to a hose. The apparatus includes an internal combustion engine in driving communication with a fluid pump having a fluid inlet and fluid outlet. The engine has a shut-off switch with a run position, no-run, and start position. The apparatus has an outlet coupling in fluid communication with the pump outlet where the outlet coupling is configured to connect to the hose of the spray gun. The apparatus also has an inlet coupling configured to connect to a fluid source and place that source in fluid communication with the inlet of the pump. The pump receives fluid from the inlet coupling and provides pressurized fluid to the outlet coupling when the pump is driven by the engine. The apparatus has a sensor located at or between the inlet coupling and outlet coupling. The sensor is configured to provide flow and no flow indications in response to a change in pressure or flow at the location of the sensor.

The apparatus also has an electronic control module configured to receive or monitor the flow and no flow indications from or at the sensor. In response to a flow indicator the control module when an engine switch is on and when a remote start switch is on, the control module activates the electric starter to start the engine running. In response to a flow stop indication from or at the sensor reflecting the stopping of fluid flow at the sensor, the control module starts a timer which measures the passage of a predetermined amount of time. If a flow start indication provided by the sensor (which reflects the resumption of fluid flow at the sensor) before the predetermined amount of time passes, then the control module resets the timer to zero and restarts the timer. The control module is configured such that if the timer is activated by the stopping of flow past the sensor and the predetermined amount of time passes then the module sends a signal causing the engine to shut off. Thus, the control module is configured to turn off the engine when the timer is activated by a stop indication at the sensor and when a flow start indication is not provided by the sensor before a predetermined time measured by the timer has elapsed. The sensor is advantageously a fluid flow sensor located on the inlet side of the pump, preferably located at or between the inlet coupling and the inlet of the pump. The sensor could be a pressure sensor located on the outlet side of the pump, preferably between the pump outlet and outlet coupling.

There is further provided an apparatus for supplying pressurized fluid to a high pressure washing device for use with a spray gun having a trigger, the spray gun connected to a hose. The apparatus includes an internal combustion engine in driving communication with a fluid pump having a fluid inlet and fluid outlet with the engine having a shut-off switch that in turn has a start and/or run position and also a no-run position. Also included is an outlet coupling in fluid communication with the pump outlet. The outlet coupling may be configured to connect to the hose. An inlet coupling is configured to connect to a fluid source and in fluid communication with the inlet of the pump. The pump receives fluid from the inlet coupling and providing pressurized fluid to the outlet coupling when driven by the engine.

The apparatus includes a sensor located at or between the inlet coupling and outlet coupling and configured to provide a flow start indication in response to a change in pressure or flow at the location of the sensor reflecting the start of fluid flow at the sensor. The sensor is further configured to provide a flow stop indication in response to a change in pressure or flow at the location of the sensor reflecting the stoppage of fluid flow at the sensor. Also, the apparatus includes an electronic control module having a timer to determine the passage of a predetermined amount of time. The module is configured to start the timer to measure the predetermined amount of time in response to a flow stop indication of the sensor. The module is configured to reset the timer with each flow start indication. But the control module is also configured to turn off the engine if the sensor does not provide a flow start indication before the predetermined amount of time has elapsed.

In further variations, the sensor may comprise a flow sensor switch, with the engine having an electronic starter and the control module is configured to start the engine in response to the first flow start indication after determining that the engine switch is turned to the run position and after determining that starting by the flow sensor is enabled. The flow sensor may be located at or between the inlet to the pump and the fluid inlet coupling. The flow sensor is preferably located by the inlet coupling.

The apparatus could have a sensor that comprises a pressure sensor located at or between the pump outlet and the fluid outlet coupling. The engine may advantageously have a manual starter in addition to the electric starter. The timer may be adjustable by the user to vary the predetermined time delay.

There is also provided a control system for a high pressure spray washing device having a housing with an engine driving a pump. The housing may have an outlet coupling for a hose connecting to a spray gun having a trigger. The housing may also have an inlet coupling for connecting to a fluid source. The pump has a pump inlet in fluid communication with the inlet coupling and a pump outlet in fluid communication with the outlet coupling so the pump can receive fluid from the inlet coupling and provide pressurized fluid to the outlet coupling and the spray gun. The control system includes a sensor and a timer. The sensor is located between the inlet and outlet couplings of the high pressure washing device. The sensor provides a flow start indication in response to the starting of flow of fluid at the location of the sensor. The sensor also provides a flow stop indication in response to the stopping of flow of fluid at the location of the sensor. The sensor is configured to provide the flow start indication when fluid flows out the outlet coupling in response to activating the spray gun trigger. The sensor is also configured to provide the flow stop indication when the spray gun stops spraying in response to releasing the spray gun trigger. The timer is activated by the flow stop indication, with the timer being reset by a flow start indication. The engine is shut off when a predetermined amount of time passes after a flow stop indication without receiving a flow start indication.

In further variations, the timer comprises an electronic circuit configured so that the predetermined amount of time may be set by a user. The timer advantageously comprises an electronic circuit configured so that the predetermined amount of time may be set by a user and wherein the predetermined amount of time is under three minutes, and preferably under 90 seconds. The sensor may comprise a flow sensor located at or between the inlet to the pump and the inlet coupling, with the flow start indication of the sensor used to activate an electric starter to start the engine. Instead of a flow sensor, the sensor may comprise a pressure sensor in which case it is preferably located between the pump outlet and the outlet coupling.

There is also provided a method for starting and stopping an engine on a high pressure spray washer having housing to which is mounted an engine driving a pump. The housing has an outlet coupling for a hose adapted to be connected to a spray gun during use, and also has an inlet coupling adapted to connect to a fluid source. The pump is in fluid communication with the inlet and outlet couplings to receive fluid from the inlet coupling and provide pressurized fluid to the outlet coupling during use. Fluid flows through the pump when the trigger is pulled to spray fluid and fluid flow through the pump stopping when the trigger releases to stop the spray of fluid. The method includes sensing one of the fluid flow or fluid pressure between the fluid inlet coupling and the fluid outlet coupling to determine the start of fluid flow to the pump when the trigger is pulled to spray fluid and providing a flow start indication. The method also includes sensing one of the fluid flow or fluid pressure between the fluid inlet coupling and the fluid outlet coupling to determine the stopping of fluid flow to the pump and providing a flow stop indication. The method may also include determining the time that passes between the flow stop indication and the following flow start indication and shutting off the engine when a predetermined length of time passes after a flow stop signal and no flow start signal has been received.

In further variations, at least one of the sensing steps uses a pressure sensor located between the outlet of the pump and the outlet coupling on the housing, or uses a flow sensor located between the fluid inlet coupling and the inlet to the pump. Advantageously the washer has a flow sensor located at or before the inlet to the pump an engine switch to shut the engine off and turn the engine off, and the washer further has an electric starter, in which case the method further includes determining whether the engine switch has been just turned on, and if the engine is not running, then in response to a flow start indication, activating the electric starter to start the engine running.

The washer may further include a switch enabling remote starting by the spray gun, in which case the method further comprises determining whether the switch enabling remote starting by the spray gun is enabled, and if it is enabled activating the electric starter to start the engine running. Further, the sensing steps may sense fluid flow at a location between the inlet coupling and pump inlet, and if the spray washer has an engine switch to shut the engine off and turn the engine off, and if the spray washer has an electric starter, then the method may further include the step of pulling the trigger on the spray gun to start the engine by causing fluid to flow through the pump and past the sensor which provides an indication communicated to a control module, the control module sending a start signal to the electric starter to start the engine.

DETAILED DESCRIPTION

Figure 1:
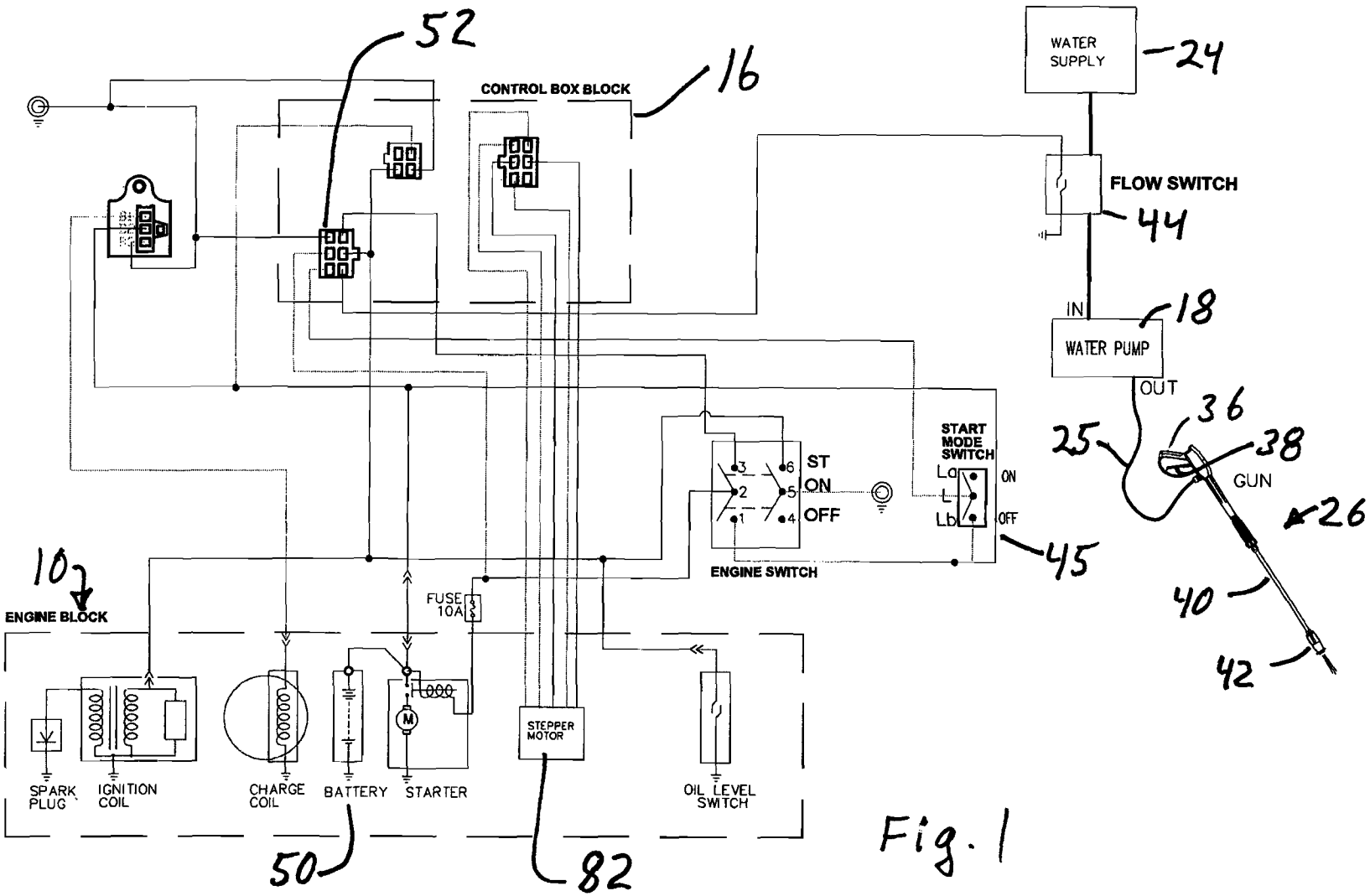
FIG. 1 is a schematic diagram of the main parts of the high pressure washer of this invention, showing exemplary electronic interconnections.
Figure 4:
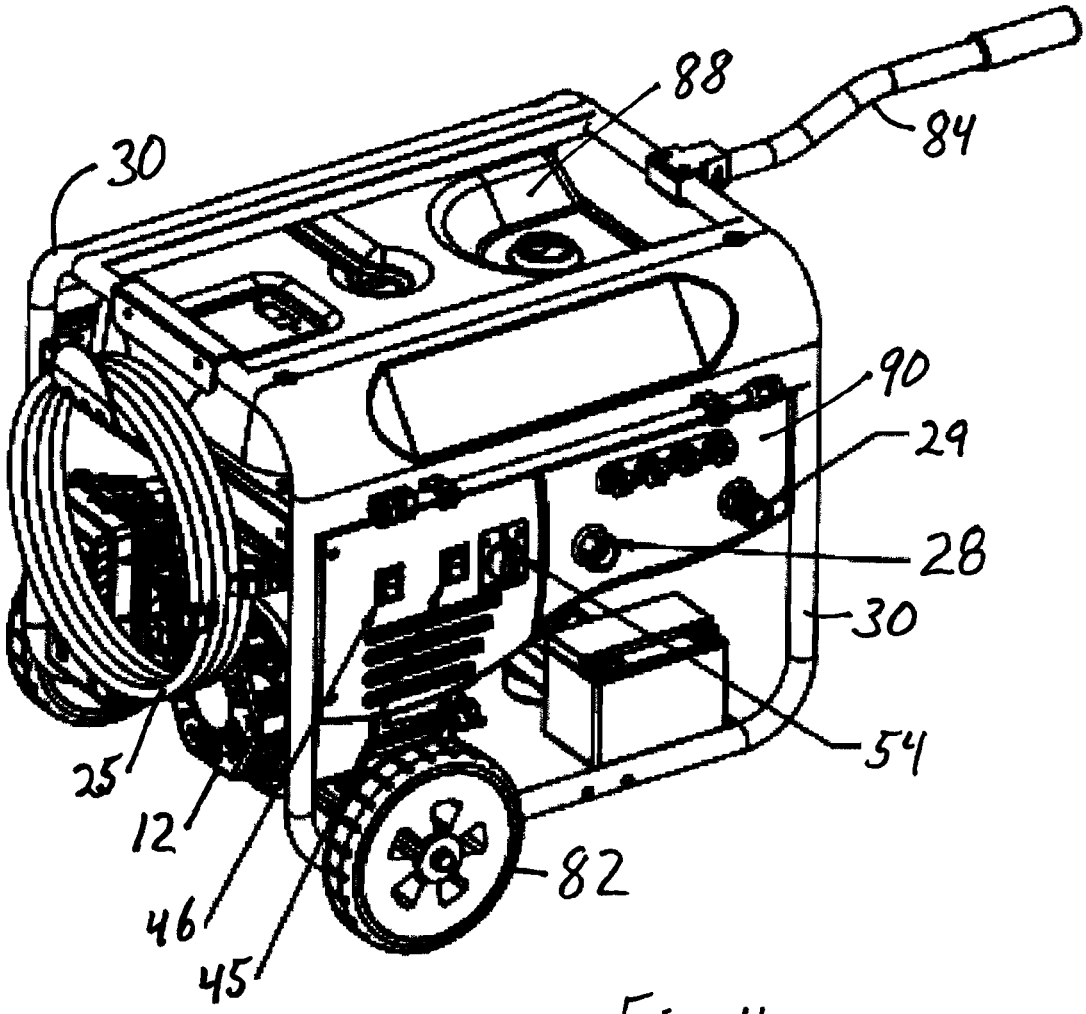
FIG. 4 is a top perspective view of a high pressure washer (without spray gun) as in claim 1.
Figure 5:
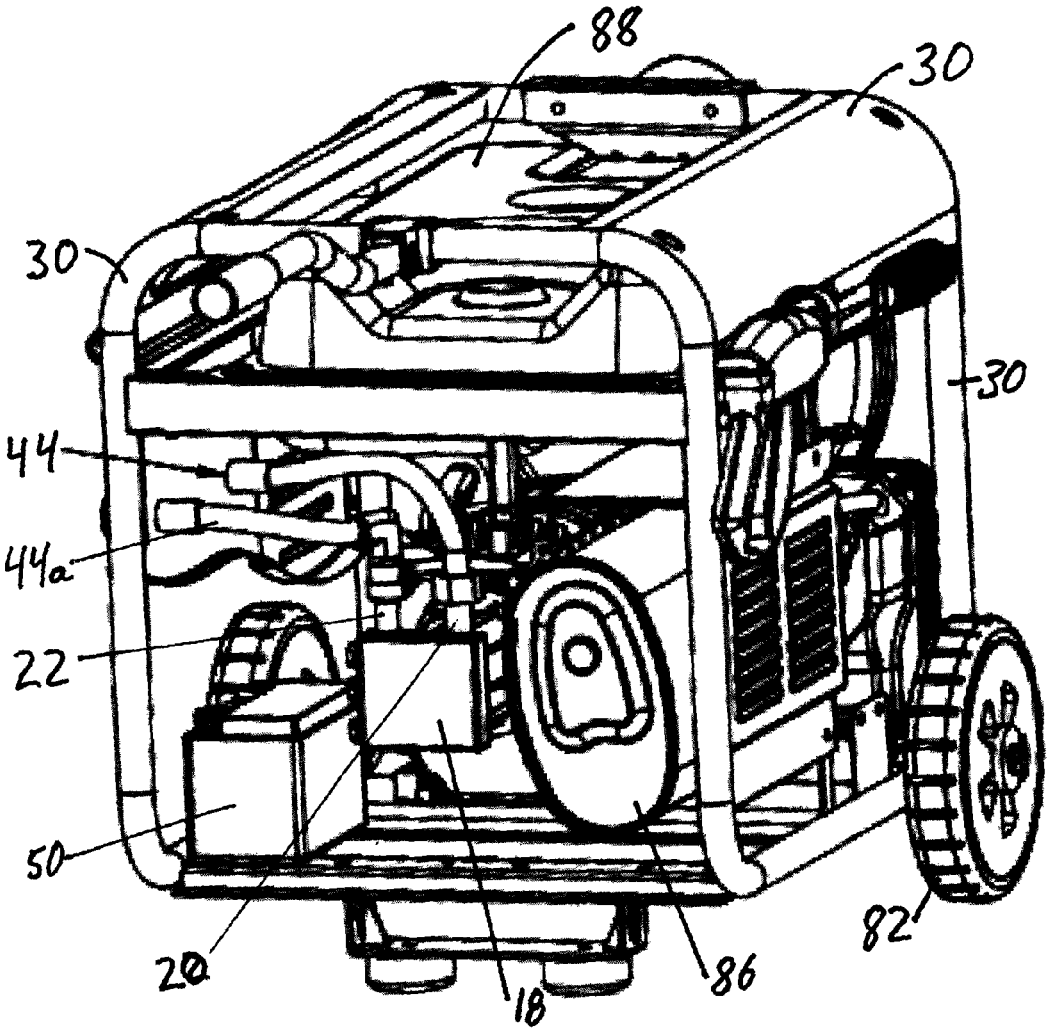
FIG. 5 is an end perspective view of the opposing side of the washer of FIG. 4.

Referring to FIGS. 1 and 4-5, an internal combustion engine 10 is provided with a manual starter 12, an electric starter 14, and an electronic module 16 allowing remote starting as discussed later. The motor 10 is drivingly connected to a fluid pump 18 having an inlet 20 and an outlet 22. The pump inlet 20 is adapted to be placed into fluid communication with a fluid source or reservoir 24. The fluid source 24 is typically a faucet with a fluid line such as a hose 25 having fittings to screw onto a bib at the fluid source. But the fluid source 24 need not be a faucet, and could be a tank accompanying the sprayer or mounted on the same equipment or platform as the engine 10. The fluid inlet typically fastens to a coupling 28 on a housing 30 on which the engine 10 and module 16 are located.

The pump outlet 22 is adapted to be placed in fluid communication with a spray gun 26, typically through an elongated hose or other flexible tubing 25. Releasable couplings 34 at opposing ends of the hose 25 are typically used to releasably connect the spray gun 26 to the pump outlet 22. The spray gun 26 has a handle 36, trigger 38, lance 40 and spray nozzle 42. During use, the engine 10 pumps fluid from the fluid source 24 through the hose 25 to the spray gun 26, with actuation of trigger 38 releasing fluid to flow through the lance 40 and nozzle 42, with the nozzle 42 constructed to create a desired spray, and the pressure from pump 10 providing the desired pressure for pressurized washing, which advantageously is about 1000-6000 psi, as higher pressures risk damaging the article being washed. Thus, upon activation, the starter 14 starts the engine 10 which drives the pump 12 to provide pressurized fluid to the gun 16. The trigger 38 on the spray gun 26 activates the spraying of pressurized fluid from the spray gun's nozzle 42. Other manually operated spray activation devices can be used as trigger 38

The engine 10 is preferably gasoline powered, and may be started several ways. First, the engine may be manually started by recoil starter 12 after an engine switch 46 is turned on to allow electrical power from an ignition coil to pass to the spark plug in the engine. The engine switch 46 has a run position which allows the engine 10 to run, and has a no-run position which stops the engine 10 from running or continuing to run, as for example, by stopping or preventing the flow of current to the spark plug of the engine 10. The switch 46 must be in the run or on position for the engine 10 to start and for the engine 10 to continue running once started. The switch 46 may be turned to the off or no-run position to stop an engine 10 that is running from continuing to run, or to stop the engine 10 from starting and running in the first place.

Second, the engine 10 may be started by the electric starter 14 and a start button 48, preferably located on the housing 30, with the start button using power from a battery 50 to crank the engine. The engine switch 46 is a three position switch which allows a start position, usually by turning the switch to run, and then pushing in on the switch and holding it to engage the starter to start the engine, after which the switch returns to the run position and remains there while the engine runs.

Figure 2:
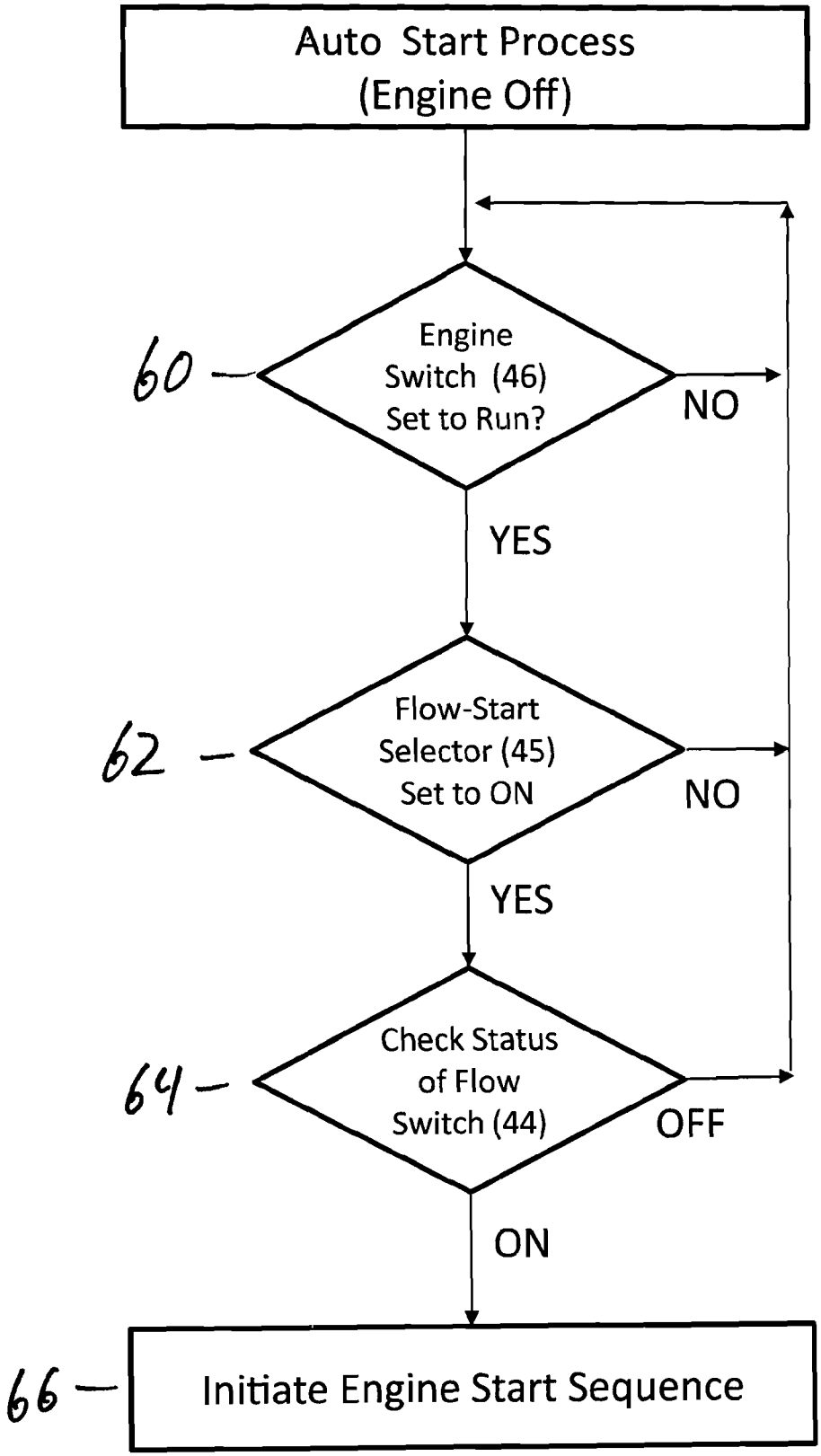
FIG. 2 is a flow diagram of the operation of a spray gun initiated, engine start sequence.

Third, the engine 10 may be started by flow sensor 44 upon actuation of trigger 38, such that trigger actuation initiates the engine starting. Referring to FIGS. 1, 2 and 4, a flow/start-enable/disable switch 45 with an on and off position, must be turned on to allow this third starting option and to avoid inadvertent starting of the engine 10. The flow sensor 44 is placed in sensing communication with the flow through the pressure washer, preferably at the pump inlet 20 so as to detect the flow of fluid into the pump 18. But because pump vibration may affect the sensor 44, the sensor may be located at or by the inlet coupling 28, advantageously on the back side of the panel to which the coupling 28 is mounted, on the fluid connection between the inlet coupling 28 and pump 18. The flow sensor is in electrical communication with the electronic control module 16 to allow starting and/or stopping of the engine 10. The engine switch 46 must also be on, and the engine 10 not running. When the trigger 38 is pressed or actuated water begins to flow through the spray gun 26, albeit at very low pressure of whatever the line pressure is (typically 30-60 psi) and at a very low flow rate. The sensor 44 detects the flow of fluid, preferably the flow into the pump 18. The flow sensor 44 is in electrical communication with an electronic control module 16 to allow starting and/or stopping of the engine 10. The flow sensor 44 detects fluid flow which is detected by control module 16 that activates electric starter 14 which starts engine 10 to provide pressurized fluid to the spray gun 26. Water is the preferred fluid.

Referring to FIGS. 1, 2 and 4, but especially FIG. 4, if the engine is off, and the switch 46 is off, no power is provided to the electronic control module 16. In step 60, the control module 16 checks to see if the engine start switch 46 is set to run. The switch 46 has a first "on" position which allows starting and running and a second, non-run (off) position which is monitored by electronic control module 16 through appropriate electrical communication. If the switch 46 is set to off, the sequence returns to the beginning. If the engine switch 46 is set to run, then the control module 16 moves to step 62 which checks to see if the flow start selector switch 45 is set to on or off. The selector 45 has an on and off position communicated to the control module 16 by appropriate electrical connections. If the selector switch 45 is off, then the spray gun starting option is not enabled and the engine cannot be started that way, but may be started manually or with the electric starter.

If the flow-start selector switch 45 is on, then the control module progresses to step 64 in which the status of the flow sensor 44 is checked. The sensor 44 may comprise a switch with an on and off position communicated to the control module 16 through appropriate electrical connections. If the sensor switch 44 is off it indicates no flow at the sensor location and the engine 10 is not started. If the switch 44 is on it indicates flow is occurring at the sensor location and the control module 16 progresses to step 66 to initiate the engine starting sequence. Thus, once engine run switch 46 is on, and once the flow-start switch 62 is on, the engine may be started by pulling the trigger 38 to cause flow into the pump, which flow causes sensor 44 to flip its switch on so the control module 16 starts the engine. Note that when a fluid or water source 24 is connected to the inlet connector 28, the pump 18 allows fluid to flow through it and to spray gun 26 even when the engine 10 is not running—as long as the trigger 38 is pulled to allow flow.

The activation and deactivation of sensor 44 can also be thought of as sending a flow signal and no-flow signal to the control module 16. Thus, flow sensor 44 effectively actuates the engine 10 by providing a flow indication that is sent to or detected by electronic module 16, whereupon, if other conditions are met, the module 16 initiates the starting of engine 10. Advantageously, the flow sensor 44 also provides an indication when the flow stops and the electronic module 16 may use that second no-flow indication to stop the engine 10 if appropriate stopping conditions are met. Viewed in terms of switches, the module 16 detects the off position of the sensor switch 44 as reflecting no flow, and viewed in terms of signals, the sensor 44 sends a flow signal and a no-flow signal. For purposes of this description the two ways of viewing the operation of the sensor 44 achieve the same result, and will be used herein as referring to a flow indication and no-flow indication by or at the sensor 44.

Since the trigger 38 is not in electrical communication with the pump 18 or engine 10, lengthy electrical connections are avoided yet engine starting and stopping can be controlled. When the user first pulls on the trigger 38 the flow of fluid through the system can be used to start the engine 10 and provide the high pressure fluid to the spray gun 26. The control module 16 also preferably has a timer 52, which may be an electronic circuit, a software implemented timer, a conventional relay timer, or any combination thereof, or any other timing device, configured such that when the user pulls the spray gun trigger 38, the timer 52 will begin counting. The engine 10 will automatically turn off when the timer reaches a predetermined amount of lapsed time if the trigger 38 is not activated so as to activate sensor 44 to indicate flow or to send a flow signal. The predetermined shut-off time period may be a single, preset value, or it may be a variable value selected by the user, as for example, an electronic selector or a rotating selector switch 54 (FIG. 4). The predetermined shut-off time is preferably between 10 to 90 seconds, but may be up to three minutes. The pre-determined time selector may be varied in increments of 5 seconds, 10 seconds or 15 seconds, or other increments. Advantageously, the selectable time variation may be implemented by software implemented by an integrated circuit forming part of the timer 52, which in turn is part of the control module 16 and its associated electronic circuitry. For illustration purposes, FIG. 1 shows the timer 52 as associated with various plug-in sockets in the control module 16 but that is conceptual as the timer can be associated with various inputs and outputs of module 16 as is appropriate to achieve the described functions herein as will be understood by one skilled in the art.

Figure 3:
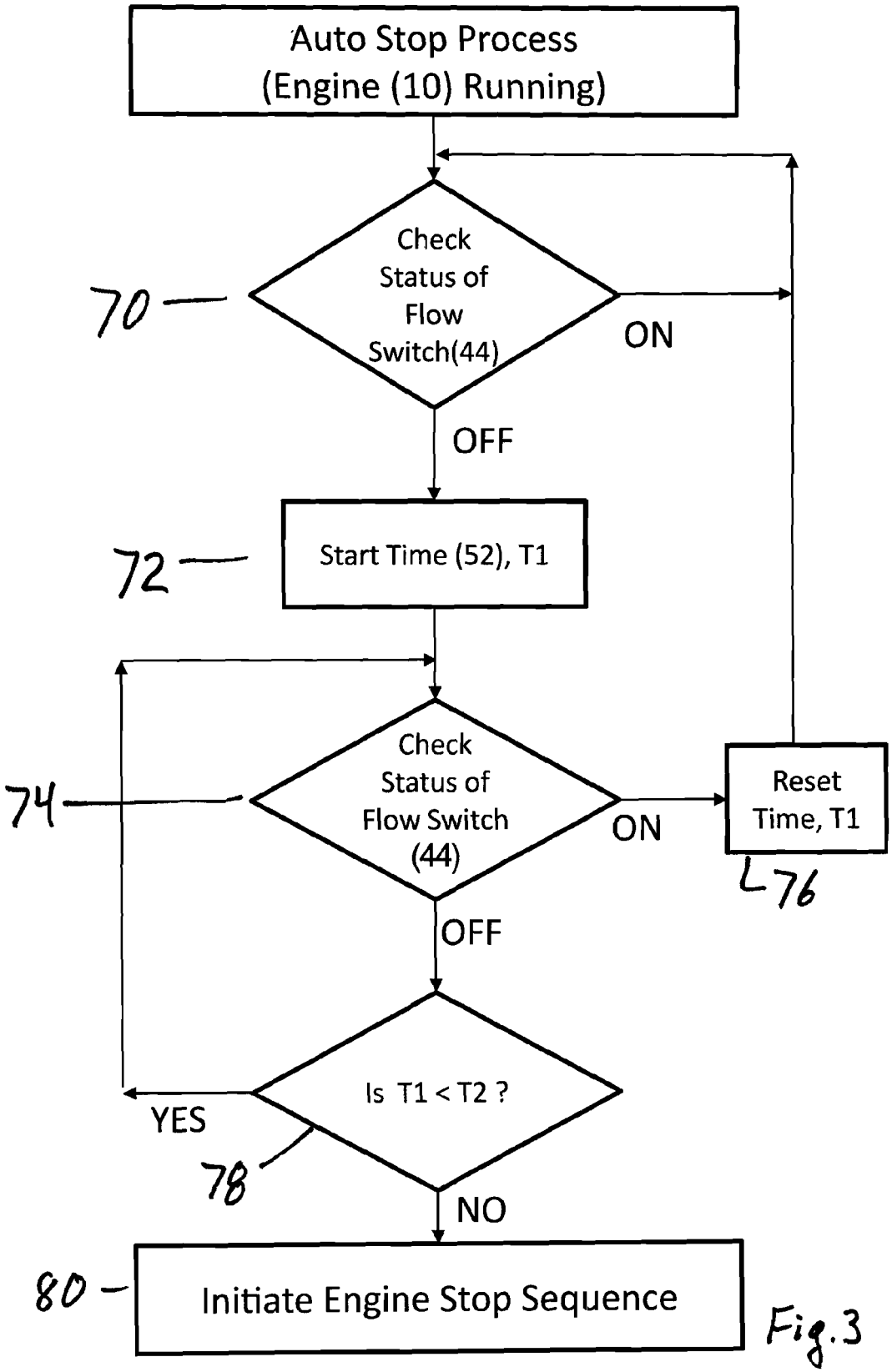
FIG. 3 is a flow diagram of the operation of a spray gun initiated, engine shut off sequence.

Advantageously the flow sensor 44 is used to monitor the operation of the spray gun 26 and shut off the engine when the preselected delay time lapses. Referring to FIGS. 1, 3 and 4, the sequence for monitoring spraying inactivity and shutting off the engine is described. With the engine 10 running, when the trigger 38 is actuated to allow flow through the spray gun 26, fluid passes through the spray washer system and the flow sensor 44 detects fluid flow. If the trigger 38 is released, the spray from nozzle 42 stops and fluid stops flowing through the spray gun 26 and begins re-circulating in a manifold of the pump 18 which bypasses the pump's fluid inlet 20 so that flow into the pump 18 stops, causing sensor 44 to detect that no fluid is flowing between the inlet and out couplings 28, 29. This sensor 44 is used to monitor operation and shut off the engine when the predetermined time has elapsed between spraying or activation of trigger 38.

In the first step 70 of the sequence in FIG. 3, with the engine 10 running, the electronic control module 16 checks the status of sensor or switch 44. The sensor 44 can be a flow sensor or pressure sensor, and FIG. 3 is labeled as a flow sensor since that is the preferred configuration, but either flow or pressure could be used. If needed, a prior step may be added to check if the engine is running before proceeding to step 70. If the switch is "on" and if fluid is flowing past the sensor 44 indicating that spraying is occurring or trying to occur (as at startup), the module 16 simply continues to check the status of the sensor 44, waiting for a change in flow condition. When the fluid flow stops, the control module 16 senses the off position of the sensor switch 44 indicating no flow past the sensor. The no-flow condition or indication by switch 44 causes the module 16 to progress to step 72 which starts a timer. The timer 52 is advantageously a timer circuit which is preferably, but optionally, within the control module 16. An integrated circuit with software programmable time delays is believed suitable for the timer 52, and is preferably included in the control module 16. The initial time is designated as T1.

After starting the timer 52, the control module progresses to step 74 which checks the status of flow sensor 44. If the sensor 44 status has change to the "on" switch position indicating flow past the sensor 44 then the timer is reset in step 76 and the sequence begins again at step 70 to periodically check the sensor 44 for a change in flow condition. Returning to step 74, if the status of the sensor 44 remains unchanged with the sensor switch in the "off" position indicating no flow, then the next step 78 checks to see if the timer value T1 is less than the predetermined time T2 set by selector 54 or preset by other means. If T1 is less than the preset time T2, then the control module returns to step 74 to recheck the status of the sensor 44 and either reset the timer per step 76, or if the sensor is unchanged, proceed to step 78 to see of T1 is less than the specified time period T2. When the sensor 44 indicates no flow for a sufficient length of time then T1 equals or exceeds the specified delay period T2 and the control module 16 progresses to step 80, which is to initiate the engine stop sequence. The control module may switch the engine off electronically, as by activating engine switch 46.

Thus, if the trigger 38 is not pulled to spray fluid and cause flow through the pump 18 and past sensor 44 before the elapsed time T2 set by the timer 52, then the circuit 16 shuts the engine 10 off. If the trigger 38 is pulled to spray fluid before the elapsed time T2 set by the timer 52, then fluid flows through the pump and outlet 29 which flow is detected by sensor 44, and the timer 52 is reset and no signal is sent to shut off the engine 10. Thus, the user of the spray gun 26 can release the trigger 38 to rest the user's finger, or to perform some small task, and the engine 10 will continue to run at operating speed and thus be ready to quickly provide spray pressure. But if the trigger is off long enough so that the predetermined time by the timer 52 has lapsed after the flow stops, then the control circuit 16 shuts the engine 10 off. Actuation of the trigger 38 causes flow through the pump 18, even when the engine 10 is not running, and that flow is detected by sensor 44 to start the engine again for further spraying. If spraying is finished, the engine switch 46 may be turned off so that the engine stops and so that actuation of the trigger 38 does not start the engine 10.

Thus, the engine 10 may be started with or without activating trigger 38, and the control circuit 16 in connection with timer 52 will shut off the engine if the trigger 38 has not been activated during the selected time interval T2 set by the timer selector 54 and implemented by the timer 52 within control module 16. As long as a user is spraying with the spray gun 26 the trigger 38 is activated continuously or intermittently, and the engine 10 runs. If the user stops spraying the timer 52 is activated and the engine 10 will be shut off in the event the spray gun is not used within the predetermined time set by the timer circuit 52. That avoids having the engine 10 shut off every time the trigger 38 is released, allows the engine to continue running and ready to provide pressure during short intervals of time when the spray gun is shut off temporarily but needs to be ready for use, and allows the spray gun 26 to effectively shut off the engine 10 after the specified time set by the timer relay 52 has passed. The automatic shut-off of the engine 10 when the spray gun 26 is not used for a predetermined length of time minimizes engine operation and that decreases fuel consumption, increases fuel economy and reduces engine exhaust.

The sensor 44 may be located anywhere between the inlet and outlet couplings 28, 29, connected to the housing 30. The sensor 44 could be in sensing communication with fluid connection between the fluid source 24 and the pump 18, or with fluid flow through the pump 12 or to the outlet coupling 29 on the housing, or along the hose 25. The sensor 44 could even be in the spray gun 16. But flow sensors for high fluid pressures are expensive, and electrical connections to sensors on the hose 25 or spray gun 26 are undesirable. The flow sensor 44 may be located between the pump inlet 20 and the fluid source 24, but is preferably near engine and pump and their associated housing or frame 30. The sensor 44 is advantageously located on the housing 30 between the inlet and outlet couplings 28, 29, is preferably located on the low pressure side of the pump 18, and more preferably located at the pump inlet 20 or the connection of the inlet coupling 28 with the tube carrying fluid to the pump. Thus, an appropriate flow sensor 44 can be located to provide the signal to circuit 16 and/or 52 that leads to the starting of engine 10 and shutting off of the engine 10.

The inlet coupling 28 is advantageously configured to accept a coupling of a garden hose, preferably and preferably comprises a female hose coupling. The engine 10 is preferably gasoline powered with an engine typically from about 80 cc to 500 cc, depending on volume and pressure desired, with an engine of about 200 cc being preferred for lower pressure applications. The engine 10 is advantageously configured to run at a speed that is at or near the maximum power for the engine as pressure washing demands a lot of power. The engine 10 is typically set to run at its maximum power speed by locking the throttle lever, although a user may be able to modify the speed.

The pump 18 is selected to provide the desirable volume of spray, with a flow rate of about 1.5 to 5 gallons per minute believed suitable. The pressure from a source 24 comprising a hose bib on a house varies from about 30-60 psi, whereas the pressure at the nozzle 42 of the spray gun 26 varies from 1,000 psi to about 5,000 psi, and may go to about 6,000 psi. Higher pressures risk damaging the articles being sprayed. An axial cam piston pump, or a crankshaft piston pump, is believed preferable. But any pump that allows flow through the pump manifold when the engine is not running is believed suitable The hose 25 is selected to operate safely at these pressures.

The selector 54 could comprise an electronic input of the type seen on microwave ovens allowing various time increments to be selected, but preferably selector 54 is a rotary switch with three or more time increments selected by the switch, with the increments varying by 15 second intervals. The control circuit 16 and/or timer relay 52 checks the value T2 selected by the selector 54 in order to determine the elapsed time for timer relay 52 which results in shutting off engine 10. Preferably, software operating on a microcircuit or integrated circuit in timer circuit 52 and module 16 can check the predetermined time of selector 54 and determine the timing, starting and stopping of the engine 10 and engine-driven pump 18. Advantageously, a stepper motor 82 (FIG. 1) is controlled by the control module 16 to regulate the choke on engine 10 to facilitate starting of the engine and reducing the choke based on engine rpm to allow easy starting and fuel efficient running of the engine.

The sensor 44 is preferably a flow sensor. The sensor 44 is preferably a magnetic reed switch type of flow sensor, but could be a flapper style or piston style of flow sensor. Other types of flow sensors could be used.

In a further embodiment, the sensor 44 comprises a pressure sensor, preferably located on housing 10 and between the inlet and outlet couplings 28, 29, used to indicate the direction of fluid flow through the pump 18, through outlet connector 29 and toward the nozzle 42. Advantageously, the pressure sensor version of sensor 44 is located on the high pressure side or outlet side of the pump 18, and is preferably not in the hose 25 or spray gun 25. Thus, the pressure sensor 44 is most preferably at or between the pump outlet 22 and the outlet coupling 29. To illustrate the location FIG. 5 identifies pressure sensor 44*a* on the outlet channel between the pump 18 and the outlet fitting. Except for the location, most of the operation is the same and thus the remaining description is provided by reference to pressure sensor 44 and that remaining description is to be understood to refer to the pressure sensor located as part 44*a* in FIG. 5 rather than the flow sensor 44 location also shown in FIG. 5.

The pressure sensor 44 detects when the pump 18 is bypassing water internally which indicates that the spray gun 25 is not spraying water. In this way the pressure sensor 44 is able to send a signal reflecting flow or no flow of fluid to the spray gun 26. When the engine 10 is off, the engine switch 46 is on, and the flow start switch is on pulling the trigger 38 will result in the pressure sensor detecting low pressure just the same as if the engine 10 were running. The low pressure reading will cause the pressure sensor to send a signal reflecting flow through the system to the controller and the engine 10 will be started. The pressure sensor 44 can be used with the timer circuit 52 to shut off the engine 10 after a predetermined delay T2. The pressure sensor 44 can operate as a switch just as the flow sensor, and the above description regarding FIG. 3 and sensor 44 is believed equally applicable to the use of a pressure sensor 44 as a flow sensor 44, and is not repeated. Alternatively viewed, the pressure sensor 44 can send a signal reflecting flow or no flow past the sensor location.

A sensor 44 configured as a pressure sensor may also be used to start and stop the engine 10. At startup the engine 10 is not running and the engine on/off switch 60 is in the run position and the flow start switch 45 is in the on position as the trigger 38 is released so as not to spray fluid. In this condition the pressure sensor 44 will be in the off position since the pump outlet pressure is low (30-60 psi). The low pressure will signal the controller in step 66 to start the engine. Effectively, the engine starts immediately upon activating the run switches. Ignition of the engine 10 will start the pump 18. Thus, the flow sequence of FIG. 2 can apply equally well to the sequence for starting the engine 10 when the sensor 44 is a pressure sensor rather than a flow sensor as described in FIG. 2. When the engine starts and the pump 18 pumps fluid, then because the trigger 38 is in the no-flow position the pump will go to the bypass flow which re-circulates fluid through the pump. A high pressure reading during the bypass flow indicates that the trigger 38 is released and no fluid is flowing through gun 26 and out nozzle 42. Referring to FIG. 3, the same sequence of events applies when the sensor 44 is a pressure sensor rather than a flow sensor. The timer circuit or relay 52 begins to count via step 72, with the flow status being checked and either reset through step 76 if the flow is actuated, or continually incremented through steps 774, 78. If the timer 52 reaches the predetermined shut-off time T2 in step 78, then the engine is stopped per step 80.

Referring to FIGS. 4-5, the pressure washer advantageously has its frame or housing 30 mounted on wheels 82 with handle 84 to allow easy movement of the spray washer. The housing 30 is illustrated as a generally rectangular shaped frame made of tubes, but other shapes and construction may be used. The engine 10 has a muffler 86 and fuel tank 88. Advantageously, the fluid inlet 28, outlet 29, switches 50, 54 and other controls are mounted on a common panel 90.

The above description is given by way of example, and not limitation. The engine 10 is advantageously directly driving the pump 18 without an intervening clutch. If a clutch is used, the above description preferably has the clutch engaged during the described operation. Given the above disclosure, one skilled in the art could devise variations that are within the scope and spirit of the invention disclosed herein, including various ways of locating the flow sensor 44 on the housing 30, and various ways of mounting the engine and pump 18 and other parts on the housing 30. As used herein, referring to a pump 18 mounted to the housing 30 includes a pump 18 that is directly or indirectly mounted to the housing 30, or more typically, mounted to a tubular frame and a few plates that form the housing. The same direct and indirect mounting applies to the engine 18, inlet and outlet couplings 28, 29 and flow sensor 44. Further, the various features of the embodiments disclosed herein can be used alone, or in varying combinations with each other and are not intended to be limited to the specific combination described herein. Thus, the scope of the claims is not to be limited by the embodiments illustrated and described herein.

What is claimed is:

1. An apparatus for supplying pressurized fluid to a high pressure washing device for use with a spray gun having a trigger which starts fluid flow regardless of the fluid pressure, the spray gun connected to a high pressure hose, the apparatus comprising:

an internal combustion engine in driving communication with a fluid pump having a fluid inlet and fluid outlet, the engine having a shut-off switch having a run position and no-run position;

an outlet coupling in fluid communication with the pump outlet, the outlet coupling being configured to connect to the hose;

an inlet coupling configured to connect to a fluid source and in fluid communication with the inlet of the pump, the pump receiving fluid from the inlet coupling and providing high pressure pressurized-fluid between 1,000 and about 6,000 psi to the outlet coupling when driven by the engine;

a sensor located at or between the inlet coupling and outlet coupling of the high pressure washing device and configured to provide a flow start indication in response to a fluid flow at the location of the sensor reflecting the start of fluid flow at the sensor in response actuation of the trigger even when the inlet coupling is in fluid communication with a fluid source without the engine running, the sensor further configured to provide a flow stop indication in response to a change in flow at the location of the sensor reflecting the stoppage of fluid flow at the sensor;

an electronic control module having a timer to determine the passage of a predetermined amount of time, the module configured to start the timer to measure the predetermined amount of time in response to a flow stop indication of the sensor, the control module being configured to turn off the engine if the sensor does not provide a flow start indication before the predetermined amount of time has elapsed, the module configured to reset the timer with each flow start indication.

2. The apparatus of claim 1, wherein the sensor comprises a flow sensor switch and wherein the engine has an electronic starter and the control module is configured to start the engine in response to the first flow start indication after determining that the engine switch is turned to the run position and after determining that starting by the flow sensor is enabled.

3. The apparatus of claim 2, wherein the sensor comprises a flow sensor located at or between the inlet to the pump and the fluid inlet coupling.

4. The apparatus of claim 3, wherein the timer is adjustable by the user to vary the predetermined time delay.

5. The apparatus of claim 2, wherein the sensor comprises a flow sensor located by the inlet coupling.

6. The apparatus of claim 2, wherein the timer is adjustable by the user to vary the predetermined time delay.

7. The apparatus of claim 1, wherein the sensor comprises a flow sensor located at or between the inlet to the pump and the fluid inlet coupling.

8. The apparatus of claim 1, wherein the engine has a manual starter.

9. A control system for a high pressure spray washing device having a housing with an engine driving a pump, the housing having an outlet coupling for a hose connecting to a spray gun having a trigger, the housing having an inlet coupling for connecting to a fluid source, with the pump having a pump inlet in fluid communication with the inlet coupling and a pump outlet in fluid communication with the outlet coupling so the pump can receive fluid from the inlet coupling and provide pressurized fluid to the outlet coupling and the spray gun, the control system comprising:

a sensor located between the inlet and outlet couplings of the high pressure washing device and providing a flow start indication in response to the starting of flow of fluid at the location of the sensor; and a flow stop indication in response to the stopping of flow of fluid at the location of the sensor, the sensor configured to provide the flow start indication when fluid flows out the outlet coupling in response to activating the spray gun trigger, with the sensor configured to provide the flow stop indication when the spray gun stops spraying in response to releasing the spray gun trigger;

a timer activated by the flow stop indication, the timer being reset by a flow start indication, the timer causing a shut off signal to be sent to the engine when a predetermined amount of time passes after a flow stop indication without receiving a flow start indication.

10. The control circuit of claim 9, wherein the timer comprises an electronic circuit configured so that the predetermined amount of time may be set by a user.

11. The control circuit of claim 9, wherein the sensor comprises a flow sensor located at or between the inlet to the pump and the inlet coupling.

12. The control circuit of claim 11, wherein the timer comprises an electronic circuit configured so that the predetermined amount of time may be set by a user and wherein the predetermined amount of time is under 90 seconds.

13. The control circuit of claim 9, wherein the sensor comprises a flow sensor, and wherein the flow start indication is used to activate an electric starter to start the engine.

14. The control circuit of claim 13, wherein the flow sensor is located at or between the inlet to the pump and the inlet coupling.

15. The control circuit of claim 9, wherein the sensor comprises a pressure sensor located between the pump outlet and the outlet coupling.

16. A method for starting and stopping an engine on a high pressure spray washer having housing to which is mounted an engine driving a pump, the housing having an outlet coupling for a hose adapted to be connected to a spray gun during use, the housing further having an inlet coupling adapted to connect to a fluid source, with the pump being in fluid communication with the inlet and outlet couplings to receive fluid from the inlet coupling and provide pressurized fluid to the outlet coupling during use, with fluid flowing through the pump when the trigger is pulled to spray fluid and fluid flow through the pump stopping when the trigger is released to stop the spray of fluid, the method comprising;

sensing the fluid flow between the fluid inlet coupling and the fluid outlet coupling of the high pressure spray washer to determine the start of fluid flow to the pump when the trigger is pulled to spray fluid and providing a flow start indication;

sensing the fluid flow between the fluid inlet coupling and the fluid outlet coupling of the high pressure spray washer to determine the stopping of fluid flow to the pump and providing a flow stop indication;

determining the time that passes between the flow stop indication and the following flow start indication; and shutting off the engine when a predetermined length of time passes after a flow stop signal and no flow start signal has been received.

17. The method of claim 16, wherein the flow sensor is located between the fluid inlet coupling and the inlet to the pump.

18. The method of claim 17, wherein the flow sensor is located by the fluid inlet coupling.

19. The method of claim 16, wherein the sensing step use a flow sensor located at or before the inlet to the pump and the spray washer has an engine switch to shut the engine off, the spray washer further having an electric starter, the method further comprising:

determining whether the engine switch has been just turned on, and if the engine is not running, then in response to a flow start indication, activating the electric starter to start the engine running.

20. The method of claim 19, wherein the housing further comprises a switch enabling remote starting by the spray gun, the method further comprising determining whether the switch enabling remote starting by the spray gun is enabled, and if it is enabled activating the electric starter to start the engine running.

21. The method of claim 16, wherein the sensing steps sense fluid flow at a location between the inlet coupling and pump inlet, and wherein the spray washer has an engine switch to shut the engine off and turn the engine off, the spray washer further having an electric starter, the method further comprising:

pulling the trigger on the spray gun to start the engine by causing fluid to flow through the pump and past the sensor which provides an indication communicated to a control module, the control module sending a start signal to the electric starter to start the engine.

* * * * *